US005564651A

United States Patent [19]

Wiemer et al.

[11] Patent Number: 5,564,651

[45] Date of Patent: Oct. 15, 1996

[54] YAW ANGLE FREE PROJECTILE

[75] Inventors: Peter Wiemer, Meerbusch; Werner Grosswendt, Ratingen, both of Germany

[73] Assignee: Rheinmetall GmbH, Dusseldorf, Germany

[21] Appl. No.: 391,834

[22] Filed: Aug. 4, 1989

[30] Foreign Application Priority Data

Aug. 5, 1988 [DE] Germany ..... 38 26 615.6

[51] Int. Cl.[6] ..... F41G 7/00

[52] U.S. Cl. ..... 244/3.21; 244/3.23; 244/3.1

[58] Field of Search ..... 244/3.1, 3.21, 244/3.23

[56] References Cited

U.S. PATENT DOCUMENTS

| | | | |
|---|---|---|---|
| 3,111,088 | 11/1963 | Fisk | 102/51 |
| 3,397,851 | 8/1968 | McNutt | 244/3.21 |
| 3,770,226 | 11/1973 | Kranz | 244/3.21 |
| 4,193,567 | 3/1980 | McCarty, Jr. . | |
| 4,373,688 | 2/1983 | Topliffe | 244/3.24 |
| 4,426,048 | 1/1984 | Mildren . | |
| 4,568,040 | 2/1986 | Metz . | |
| 4,681,283 | 7/1987 | Kranz . | |
| 4,886,223 | 12/1989 | Gartner | 244/3.23 |
| 4,899,956 | 2/1990 | King et al. | 244/3.21 |
| 4,927,096 | 5/1990 | Kranz . | |

FOREIGN PATENT DOCUMENTS

| | | |
|---|---|---|
| 0081421 | 6/1983 | European Pat. Off. . |
| 694533 | 8/1940 | Germany . |
| 2830859C2 | 3/1979 | Germany . |
| 3429798C1 | 12/1985 | Germany . |
| 3606423A1 | 9/1987 | Germany . |
| 808032 | 1/1959 | United Kingdom . |
| 2002885 | 2/1979 | United Kingdom.. |
| 2203223 | 10/1988 | United Kingdom . |
| WO88/04400 | 6/1988 | WIPO . |

*Primary Examiner*—Mark Hellner
*Attorney, Agent, or Firm*—Spencer & Frank

[57] ABSTRACT

A fin stabilized projectile for combatting a tank from above of the type including a rotating control unit disposed at the front of the projectile and containing a sensor for scanning the area to detect a target, and wherein the final phase of flying into the target is initiated by a force which acts on the tip of the projectile, particularly on the control unit. Since the control unit rotates relative to the warhead of the projectile to enable its sensor to detect the target, the gyro effect of this rotary movement generates pendulum movements in the projectile and thus causes deviations from the target at different target distances. To avoid yaw angles and lateral displacements of the projectile during the rotating-descending phase, a drive arrangement is provided within the projectile between the control unit and the warhead to impart an angular momentum to the warhead corresponding to the angular momentum of the control unit but directed in the opposite direction. Preferably this drive arrangement simultaneously serves as the drive for producing the rotation of the control unit.

4 Claims, 3 Drawing Sheets

YAW ANGLE FREE PROJECTILE

REFERENCE TO RELATED APPLICATIONS

This application claims the priority of Federal Republic of Germany application Ser. No. P 36 03 497.5 filed Aug. 5th, 1988, which is incorporated herein by reference.

BACKGROUND OF THE INVENTION

The present invention relates to a projectile for combatting a tank from above, the projectile including a warhead and a control unit which rotates relative to the warhead during flight and which contains a search head for detecting a target and for causing the projectile to be directed toward the target.

In such a projectile, as disclosed in German Application P 3,603,497.5, corresponding to U.S. Pat. Application Ser. No. 07/018,567, filed Feb. 4th, 1987 by Grosswendt et al, the entire subject matter which is incorporated herein by reference, the rotating control unit may cause gyro effects during the flying maneuver to convert the projectile from the traveling phase to the rotating-descending phase and these gyro effects may result in undesirable influences on the trajectory. In this connection, it is considered to be a drawback that, in addition to the desired large pitch angles, undesirable, large yaw angles and lateral displacements of the projectile inevitably occur. The term lateral displacement is here understood to mean the lateral deviation of the projectile in the target. In the past, it had been attempted to reduce yaw angles and deviations by employing a lead yaw angle, with such a lead yaw angle being formed by an angle between the sensor picking up the target and a pulse actuated charge. However, the relationship between the mechanically caused yaw angle and the aerodynamic reaction to it in the form of a lateral displacement is not linear and therefore only difficult to calculate. Moreover, different starting conditions, such as, for example, different target distances, target heights, final velocities, etc., must be considered when the projectile changes over to the rotating-descending phase so that it is generally impossible to reduce yaw angles and lateral displacements to a minimum or prevent them from occurring at all if only one lead yaw angle is employed for all target distances.

SUMMARY OF THE INVENTION

It is an object of the present invention to avoid lateral displacement of the projectile during its final approach to the target in the rotating-descending phase under different starting conditions and to ensure that it hits with a yaw angle of 0 degrees.

The above object is generally achieved according to the present invention by a projectile for combatting a tank from above, with the projectile including a warhead body, a control unit rotatably mounted on the warhead body, and drive means for causing the control unit to rotate relative to the warhead body with an angular momentum during flight; and wherein means are provided on the projectile between the control unit and the warhead body for imparting an angular momentum to the warhead body corresponding to the angular momentum of the control unit but acting in the opposite direction in order to compensate the angular momentum of the control unit. Preferably, the means for imparting an angular momentum tothe warhead is the drive means for causing the control unit to rotate.

With the use of the momentum imparting arrangements proposed by the invention it is accomplished, in an advantageous manner, that the total angular momentum of the projectile becomes zero so that the drawbacks created by the gyro effect can no longer occur. Under the condition that no external torques act on the closed projectile system-warhead and control unit-the arrangements employed prevent, in particular, the occurrence of yaw angles and lateral displacements of the projectile in the target. The momentum imparting arrangements provided means proposed by the present invention initiate an internal angular momentum of the same amount which acts in the opposite direction in such a way that the sum of the angular momentums L is compensated, i.e. becomes zero:

$$L_{warhead}+L_{control\ unit}=0$$

Thus the number of revolutions of the sensor can be increased for uninterrupted scanning so that, in a particularly advantageous manner, only one sensor instead of several sensors is required in the control unit. Moreover, the present invention also contributes to a considerable increase in the pitch angle velocity of the projectile so that the projectile is able to attack the target in the most vertical orientation possible. This possibility of attacking was not given in the prior art solution due to the occurrence of the gyro effect and the disadvantageous yaw angles and displacements resulting therefrom.

The arrangements according to the invention cause the warhead and the control unit to rotate simultaneously in opposite directions. Several possible solutions are proposed to realize this. In all specifically disclosed solutions, the arrangement employed to generate the angular momentum of the warhead simultaneously serves as a drive to cause the control unit to rotate.

According to one embodiment, gases from a pyrotechnic drive for the warhead emanate tangentially from nozzles and simultaneously cause rotation of an impeller wheel which surrounds a portion of the warhead and is connected with the control unit.

According to another embodiment, separate discharge nozzles in the warhead and in the control unit are charged with gas by a common pyrotechnic drive so that the above-described components rotate in opposite directions. Since the rotation is caused by the high energy density of a propelling charge, these solutions produce only slight additional weight.

The same effect can also be realized by reliably operating, maintenance friendly and simply constructed mechanical arrangements, for example a coil spring or a screw thread.

BRIEF DESCRIPTION OF THE DRAWINGS

The present invention will be described below in greater detail with reference to embodiments that are illustrated in the drawing figures.

DETAILED DESCRIPTION OF THE PREFERRED EMBODIMENTS

Figure 1:
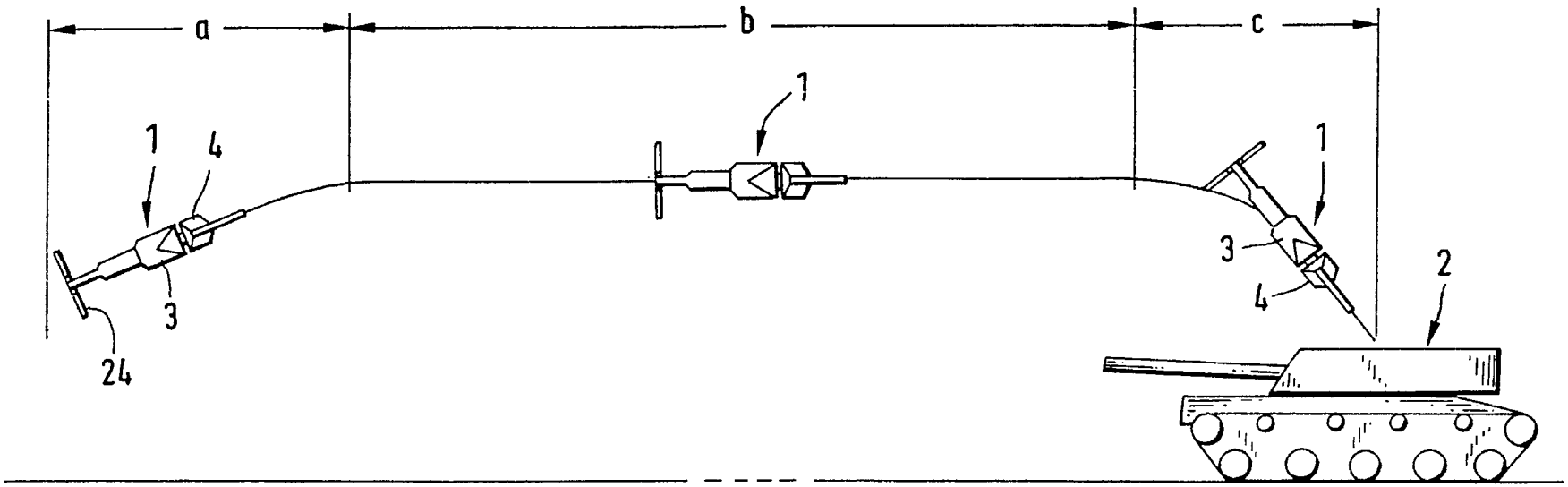
FIG. 1 is a schematic showing of a fin stabilized projectile including a warhead and a rotating control unit of the type to which the present invention is directed in various phases of flight.

FIG. 1 shows the flight path, in various phases of flight a, b and c, of a fin stabilized projectile 1 as disclosed in the above identified U.S. Application Ser. No. 07/018,567 for combatting a tank 2 from above. This projectile 1 is post-accelerated, for example, via an onboard rocket engine, after it leaves a weapon (not shown) during its first flying phase a, while in the subsequent traveling phase b a greater distance is covered. In the transition to the rotating-descending phase c, which is initiated in a manner not shown by means, for example, of a pulse actuated explosive charge to pivot the projectile about its center of gravity, this projectile 1 exhibits the above-described drawbacks caused by the gyro effect in a control unit 4 which rotates relative to warhead 3 and which contains a search head. During the change-over bend from traveling phase b to rotating-descending phase c, the rotation of control unit 4 in this projectile 1 causes an angular momentum generated by the rotation to act on the stability of the direction of flight of projectile 1 in such a manner that the projectile 1 is forced to continue its flight under an unavoidable greater or smaller yaw angle, with resulting pendulum movements of the projectile.

FIGS. 2 to 9 are limited exclusively to an illustration of the portion of this projectile 1 relevant to the present invention and illustrate various possible solutions to avoid the pendulum movements of the projectile 1 caused by the gyro effect when it changes over to rotating-descending phase c. In each of the embodiments shown in FIGS. 2, 4, 7 and 9, the angular momentum of the respective control unit 4.2, 4.4, 4.7 or 4.9 is compensated by the provision of arrangement 5.2, 5.4, 5.7 or 5.9 between the respective control unit and the respective body 3.2, 3.4, 3.7 or 3.9 of the respective warhead 3. These respective arrangements 5.2, 5.4, 5.7 and 5.9 impart an angular momentum to the respective warhead body which corresponds to but counteracts the angular momentum of the respective control unit. These arrangements 5.2, 5.4, 5.7 and 5.9 are suitable to simultaneously utilize the here additionally desired angular momentum of warhead 3 for rotation of the sensor (not shown) provided for target detection in the respective control units 4.2, 4.4, 4.7 and 4.9. The arrangements 5.2, 5.4, 5.7 and 5.9 cause the angular momentum, control unit generated during rotation of the respective control units 4.2, 4.4, 4.7 and 4.9 to be compensated by an oppositely acting angular momentum, $L_{warhead}$, of the warhead. The total angular momentum L of the projectile 1 thus becomes zero and follows the following equation:

$$L=\omega_{ST}\times\Theta_{ST}-\omega_{GK}\times\Theta_{GK}=0$$

where $\omega_{ST}$ is the angular velocity of the control unit;

$\omega_{GK}$ is the angular velocity of the warhead body;

$\Theta_{ST}$ is the moment of inertia of the control unit; and $\Theta_{GK}$ is the moment of inertia of the warhead body.

Due to the fact that the moment of inertia $\Theta_{GK}$ is greater by a multiple than the moment of inertia $\Theta_{ST}$, it is possible, with the angular velocities of the warhead body ($\omega_{GK}$) being lower in inverse proportion thereto, to generate high angular velocities for the control unit and, according to the formula $$\omega_{ST}=2\times\pi\times\gamma$$

very high numbers of revolution $\gamma$. The various drive systems according to the invention are able to accelerate the target detection control unit 4.2, 4.4, 4.7 and 4.9, for example, to about 60 revolutions per second.

Figure 2:
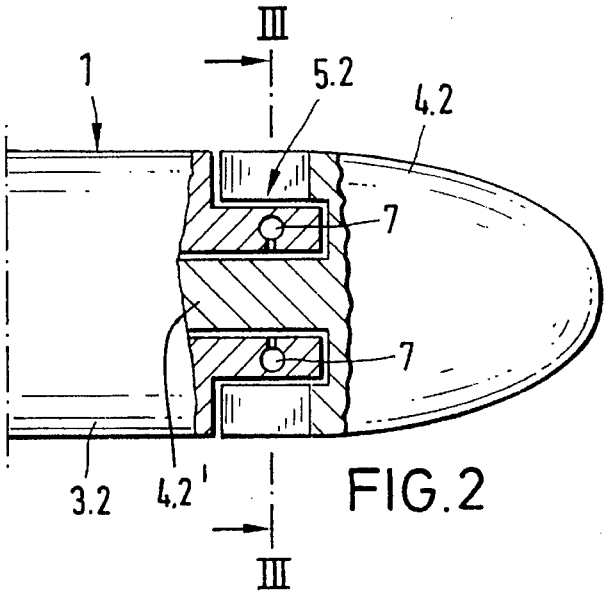
FIG. 2 is a schematic partial sectional side view of a control unit and a warhead of a projectile which are driven by a common pyrotechnic driving charge according to one embodiment of the invention.
Figure 3:
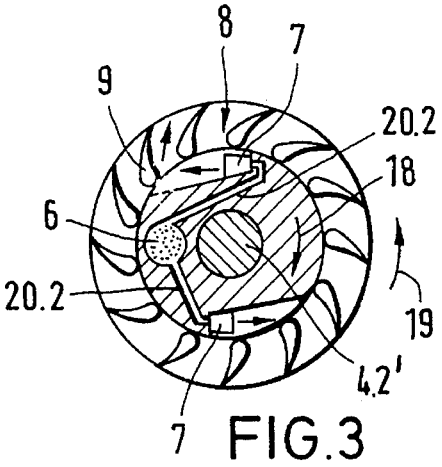
FIG. 3 is a cross-sectional view of the projectile along the section line marked III—III in FIG. 2.

Turning now to FIGS. 2 and 3, there is shown a first embodiment of an arrangement 5.2 according to the invention for imparting an angular momentum to the warhead body 3.2 corresponding to the angular momentum of the control unit 4.2 but in the opposite direction. As shown, the control unit 4.2 is rotatably mounted on the front end of the body 3.2 for rotation about the longitudinal body axis by means of a rearwardly extending axial projection or axle 4.2' which extends into an axial bore in the end surface of the body 3.2 wherein it is supported or journaled for rotation in a known manner (not specifically shown). In this embodiment, the momentum imparting arrangement 5.2 is composed of at least two gas nozzles 7 which are connected via lines 20.2 with a propelling charge 6 disposed within body 3.2, and which are arranged tangentially and symmetrically opposite one another on the circumference of body 3.2, and of an impeller ring 8 which encloses the portion of the circumference of body 3.2 having the nozzles 7 and which is connected to the control unit 4.2. The impeller ring 8 is provided with vanes 9 which deflect the gases exiting from the nozzles 7. As a result of this deflection of the driving gases exiting from nozzles 7 by the vanes 9 of impeller ring 8, which is part of control unit 4.2, body 3.2 is caused to rotate, for example, in a clockwise direction 18 in the illustrated embodiment, while control unit 4.2 is caused to rotate in the opposite direction, i.e., counterclockwise in a direction 19 as shown. More than two nozzles 7 may be disposed within body 3.2 and distributed uniformly over its circumference for cooperation with the vanes 9. Such nozzles 7 all are connected by way of respective lines 20.2 with the propelling charge 6 which, for example, is the charge of a small rocket drive which is initiated during flight phase a to provide the post acceleration.

Figure 4:
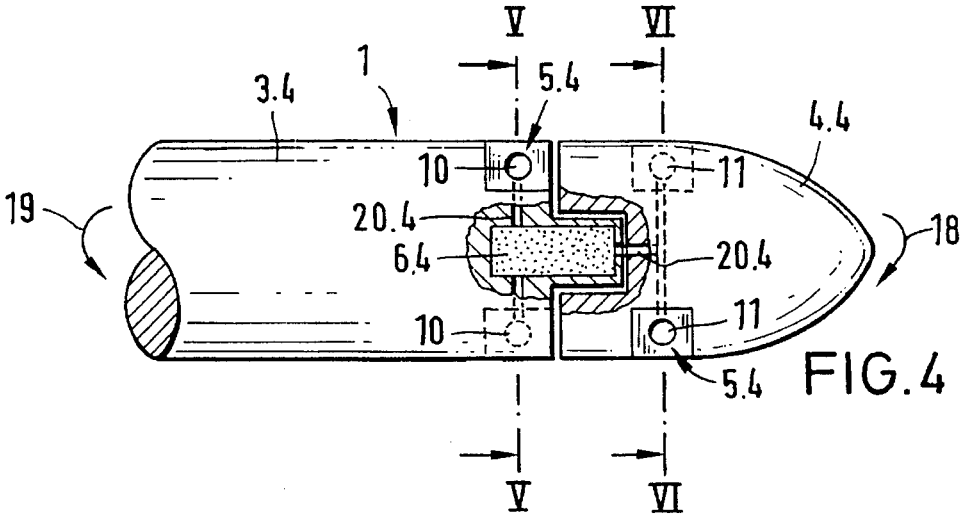
FIG. 4 is a schematic partial sectional side view of a control unit and a warhead of a projectile which are driven separately by pyrotechnic drives according to a further embodiment of the invention.
Figure 5:
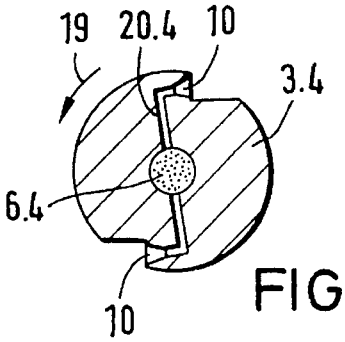
FIG. 5 is a cross-sectional view of the warhead seen along the section line marked V—V in FIG. 4.
Figure 6:
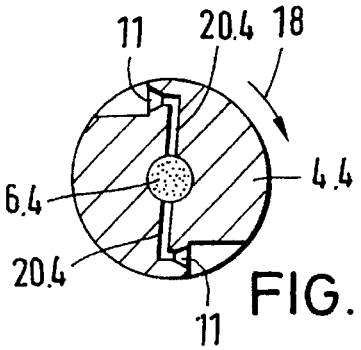
FIG. 6 is a cross-sectional view of the control unit seen along the section line marked VI—VI in FIG. 4.

According to the embodiment shown in FIGS. 4 to 6, the momentum imparting arrangement 5.4 is composed of at least two gas nozzles 10 which are disposed symmetrically opposite one another adjacent the circumferential surface of body 3.4, and at least two tangentially oriented nozzles 11 which are disposed symmetrically opposite one another adjacent the circumferential surface of the control unit 4.4. Nozzles 10 and 11 are here charged via lines 20.4 jointly by a single propelling charge 6.4 (or simultaneously by separate propelling charges (not shown) each of the same charge quantity) which is ignited during flight of the projectile. As shown, the nozzles 10 of body 3.4 are oriented in the relatively opposite direction than the nozzles 11 of control unit 4.4 so that here control unit 4.4 can be caused to rotate in a clockwise direction 18 and body 3.4 in a counterclockwise direction 19.

Figure 7:
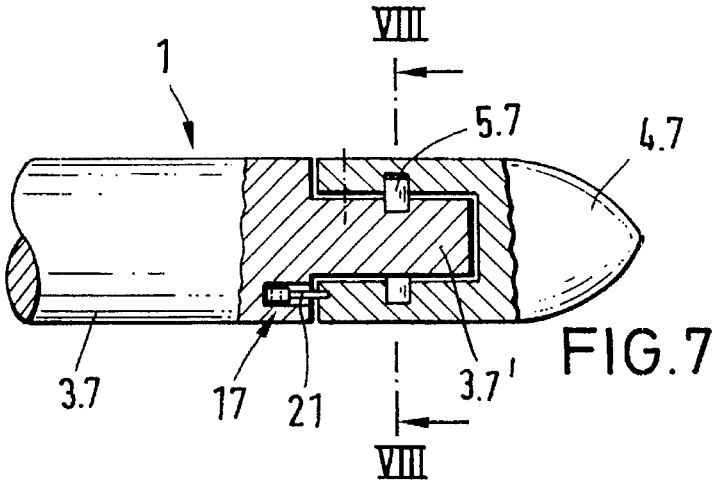
FIG. 7 is a schematic partial sectional side view of a control unit and a warhead of a projectile which are caused to rotate by means of a coil spring according to another embodiment of the invention.
Figure 8:
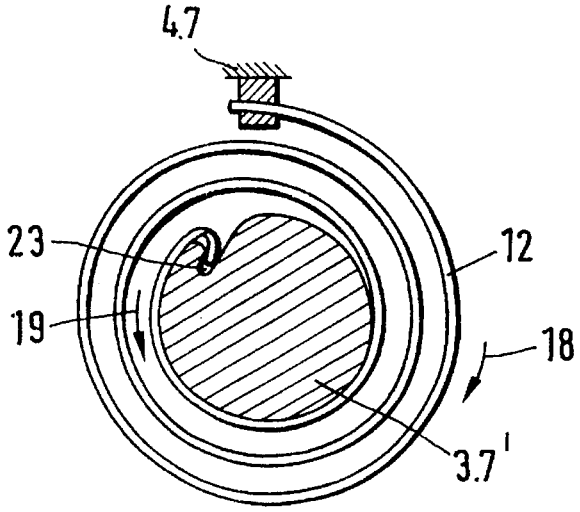
FIG. 8 is a cross-section view of the projectile along the section line marked VIII—VIII in FIG. 7.

According to the embodiment shown in FIGS. 7 and 8, the momentum imparting arrangement 5.7 is composed of a helical coil spring 12 having one end rigidly fastened to the interior surface of control unit 4.7 and its other end releasably fastened to the exterior surface of the body 3.7 of warhead 3. As shown the releasable connection is provided by a bent end of the spring 12 which engages in a slot or groove 23 formed in the surface of the forward axial projection portion 3.7' of body 3.7. The spring 12 is initially tightly wound and the control unit 4.7 is initially held in a fixed position against rotation relative to the body 3.7 by a safety device 17. This safety device against rotation 17 becomes ineffective during the initial acceleration of the projectile, and releases the control unit 4.7 to cause the spring 12 to unwind and impart the angular momentum. This safety device 17 is, for example, composed of a spring charged axially disposed pin 21 which is disposed in a longitudinally extending blind bore in the body 3.7, and which initially engages in a baore in the control unit 4.7, and which, due to its inertia during the starting phase, is urged entirely into a bore 22 of the body 3.7, and thus releases the control unit 4.7 from its held or rotation locked position.

Figure 9:
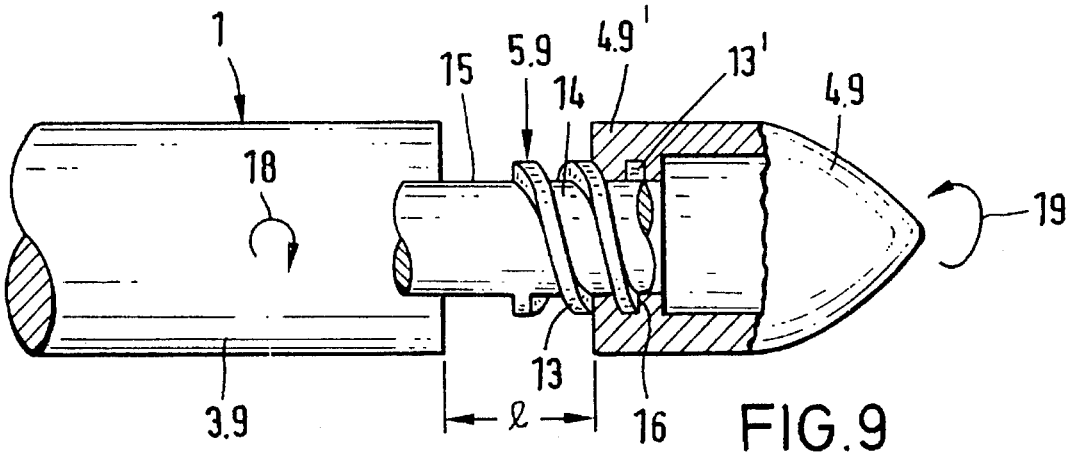
FIG. 9 is a schematic partial sectional side view of a control unit and a warhead of a projectile which are caused to rotate by means of a screw thread according to a still further embodiment of the invention.

FIG. 9 shows still another embodiment wherein the momentum imparting arrangement 5.9 is an external screw thread 13 disposed on the front portion of an axle or projection 14 extending from the front end surface of body 3.9 and engaged by a thread 13' in the interior surface of a reduced inner diameter portion 4.9' extending from the rear end surface of the control unit 4.9. As shown, the inner diameter of portion 4.9' corresponds substantially to that of the outer diameter of axle 14 (at an idling or threadless portion 15) but is provided with sufficient clearance to permit relative rotation with little friction.

In this embodiment, the thread 13' of control unit 4.9 goes into an engagement position 16 with the screw thread 13 on projectile 14 during the starting phase of projectile 1, and the control unit 4.9 travels backward relative to the body 3.9 while rotating during flight until the portion 4.9' positions itself on the idling portion or seat 15 on the axle or projection 14 of body 3.9, whereby the thread 13' is disengaged from the thread 13. The clockwise rotation 18 of body 3.9 and the counterclockwise rotation 19 of control unit 4.9 are generated in the acceleration phase during start of the projectile 1 in that control unit 4.9, which is disposed initially at a distance l in front of body 3.9, is moved under its own inertia and under the guidance of screw thread 13 toward warhead body 3.9. The pitch of screw thread 13 is selected such that control unit 4.9 is able to slide along it with little friction. At the end of stroke l, control unit 4.9 is unlatched from the screw thread profile of projection 14 so that control unit 4.9 is able to unimpededly rotate on idling seat 15.

In all illustrated embodiments, a possibly unilateral loss of angular momentum of warhead 3 due to its fins 24 (FIG. 1) being unfolded during flight (FIG. 1) can be compensated by an appropriate sloping of fins 24.

The invention now being fully described, it will be apparent to one of ordinary skill in the art that any changes and modifications can be made thereto without departing from the spirit or scope of the invention as set forth herein.

What is claimed:

1. A projectile for combatting a tank from above, including a warhead body, a control unit rotatably mounted on said warhead body, and drive means provided on said projectile between said control unit and said warhead body, for causing said control unit to rotate relative to said warhead body with an angular momentum during flight and for imparting an angular momentum to said warhead body corresponding to the angular momentum of said control unit but acting in the opposite direction in order to compensate the angular momentum of said control unit; and wherein said drive means comprises: at least two gas nozzles disposed symmetrically opposite one another on the circumference of said warhead body and tangentially oriented; a propelling charge disposed within said warhead body and connected with said nozzles via gas channels in said body; and an impeller ring surrounding said nozzles and connected with said control unit for deflecting gas discharged from said nozzles.

2. A projectile for combatting a tank from above, including a warhead body, a control unit rotatably mounted on said warhead body, and drive means, provided on said projectile between said control unit and said warhead body, for causing said control unit to rotate relative to said warhead body with an angular momentum during flight and for imparting an angular momentum to said warhead body corresponding to the angular momentum of said control unit but acting in the opposite direction in order to compensate the angular momentum of said control unit; and wherein said drive means comprises: a first plurality of gas nozzles symmetrically disposed around the circumference of said warhead body and tangentially oriented to cause rotation of said warhead body in a first direction of rotation; a second plurality of gas nozzles disposed symmetrically around the circumference of said control unit and tangentially oriented to cause rotation of said control unit in a direction opposite said first direction; and propellant charge means, disposed in said projectile, for charging said first and second plurality of nozzles with the same quantity of propelling charge.

3. A projectile for combatting a tank from above, including a warhead body, a control unit rotatably mounted on said warhead body, and drive means, provided on said projectile between said control unit and said warhead body, for causing said control unit to rotate relative to said warhead body with an angular momentum during flight and for imparting an angular momentum to said warhead body corresponding to the angular momentum of said control unit but acting in the opposite direction in order to compensate the angular momentum of said control unit; and wherein said drive means comprises: a wound helical coil spring which surrounds a portion of said warhead body and has one end rigidly fastened to an interior surrounding surface of said control unit and its other end releasably fastened to an exterior surface of said portion of said warhead body; and means, responsive to the initial acceleration of said projectile, for releasing a rotation preventing connection between said control unit and said warhead body to activate the angular momentum of said spring and permit said spring to unwind.

4. A projectile for combatting a tank from above, including a warhead body, a control unit rotatably mounted on said warhead body, and drive means, provided on said projectile between said control unit and said warhead body, for causing said control unit to rotate relative to said warhead body with an angular momentum during flight and for imparting an angular momentum to said warhead body corresponding to the angular momentum of said control unit but acting in the opposite direction in order to compensate the angular momentum of said control unit; and wherein said drive means comprises: a rod-shaped projection extending from a front end surface of said warhead body and provided with an external thread on a first front portion and a threadless idling portion between the front portion and said front end surface; an internal thread provided in an inner surface portion of said control unit which extends forwardly from a rear end surface of said control unit and which has a diameter corresponding to the diameter of said projection, and said internal thread engaging the front of said external screw thread during the starting phase of the projectile flight so that the inertia of said control unit causes said inner surface portion of said control unit to travel along said projection to a position on said idling portion of said projection, where said internal and external threads are disengaged, during the flying phase of the projectile.

* * * * *